United States Patent [19]

Suzuki

[11] Patent Number: 4,572,019

[45] Date of Patent: Feb. 25, 1986

[54] CONTROL DEVICE FOR CONTROL CABLES

[75] Inventor: Kazuhiro Suzuki, Nishinomiya, Japan

[73] Assignee: Nippon Cable System, Inc., Takarazuka, Japan

[21] Appl. No.: 535,188

[22] Filed: Sep. 23, 1983

[30] Foreign Application Priority Data

Mar. 22, 1983 [JP] Japan ..... 58-48320

[51] Int. Cl.[4] ..... G05G 9/02

[52] U.S. Cl. ..... 74/471 XY; 74/501 R

[58] Field of Search ..... 74/471 XY, 501 R

[56] References Cited

U.S. PATENT DOCUMENTS

| | | | |
|---|---|---|---|
| 3,541,877 | 11/1970 | Houk | 74/471 |
| 3,786,689 | 1/1974 | Houk | 74/471 XY |
| 4,019,401 | 4/1977 | Drone | 74/471 XY |
| 4,187,737 | 2/1980 | Mori et al. | 74/471 XY |

*Primary Examiner*—Andrew M. Dolinar

*Attorney, Agent, or Firm*—Armstrong, Nikaido, Marmelstein & Kubovcik

[57] ABSTRACT

A control device for control cables comprising a housing, a spherical bearing provided with the housing, a main shaft inserted into the spherical bearing, a lever base to which both ends of the main shaft are fixed, ball joints which are pivotally provided with the lever base at positions in the axial direction of the main shaft and in the perpendicular direction to the axis center of the spherical bearing, and a guide stopper for restricting a rotational motion of the main shaft around the spherical bearing, whereby at least two control cables connected to the ball joints can be independently together or simultaneously operated by means of a single lever fixed to the lever base. The control device is small, light and inexpensive to manufacture.

1 Claim, 3 Drawing Figures

CONTROL DEVICE FOR CONTROL CABLES

BACKGROUND OF THE INVENTION

The present invention relates to a control device for control cables, whereby a single lever can be employed to operate multiple control cables.

A control cable (hereinafter reffered to as "cable") comprises fundamentally a flexible conduit and a flexible inner cable comprising a strand of steel wire, which is slidably inserted into the conduit, and is constructed so as to transmit a push or pull load acted on one end of the inner cable to the other end in order to operate a remote driven apparatus.

With respect to a control device in which a single lever is employed to operate two cables, hitherto, many types of devices have been proposed. Those devices are large since the devices comprise many elements, e.g. teeth gears, Hooke's universal joint, and the like, and the constructions of the devices are very complicated. Also, it is unavoidable that those devices are heavy since most of members constituting the devices are prepared through cutting processes from a steel block, or the like, which are generally heavy in comparison with pressed steel plates. Further, it is unavoidable that the cost is high, since many slidable or rotatable connections which require high accuracy are used.

OBJECT OF THE INVENTION

In the light of the disadvantages of the above conventional devices, the main object of the present invention is to provide a control device that is relatively small and light due to a simple construction and is inexpensive to manufacture though the device has high accuracy.

These and other objects and advantages of the present invention will become apparent from the following description with reference to the accompanying drawings.

DETAILED DESCRIPTION OF THE INVENTION

Figure 1:
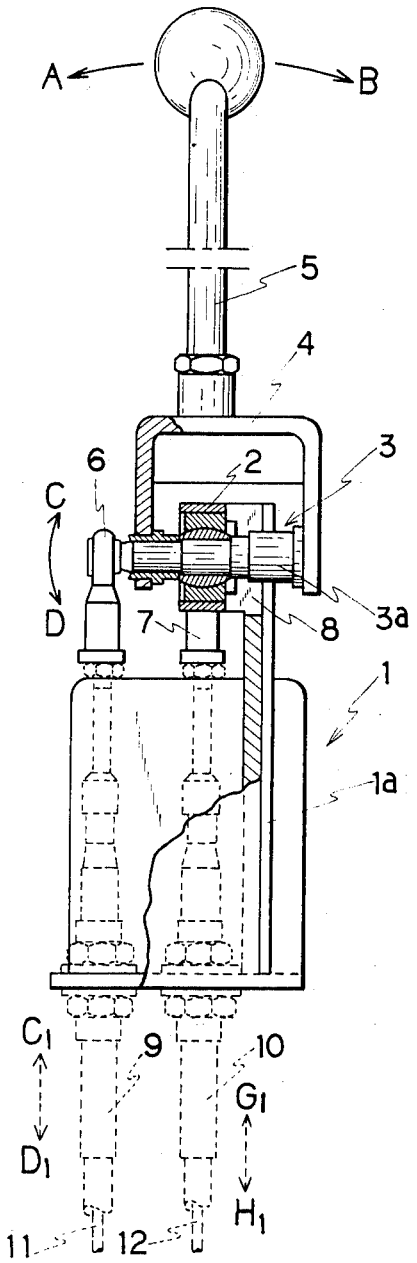
FIG. 1 is a partially cutaway front view showing an embodiment of a control device for control cables of the present invention.
Figure 2:
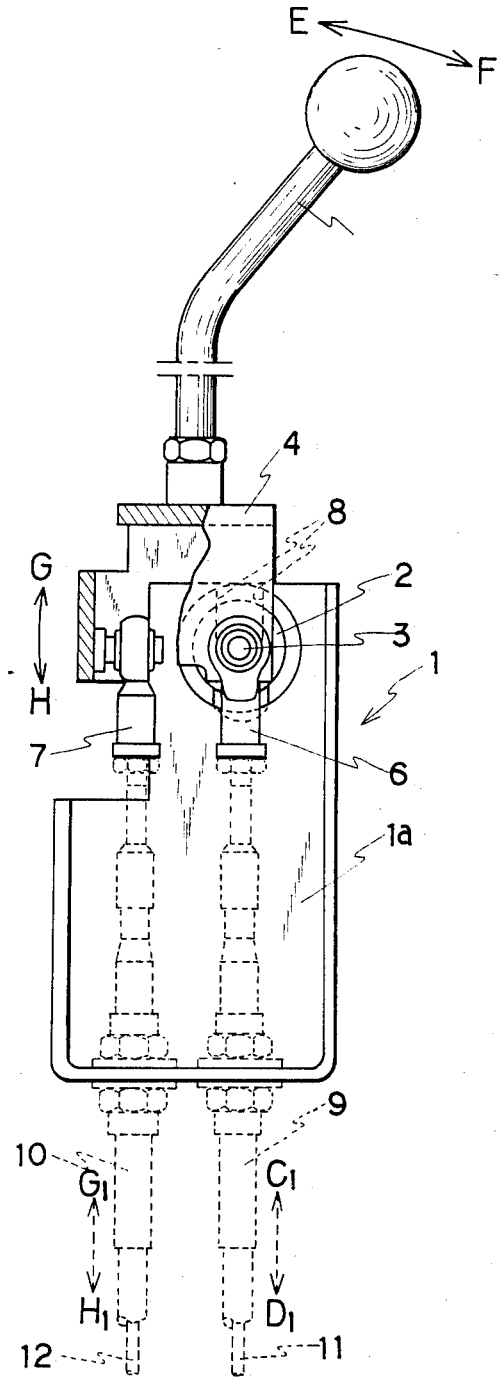
FIG. 2 is a partially cutaway side view showing the embodiment of the control device of the invention shown in FIG. 1.
Figure 3:
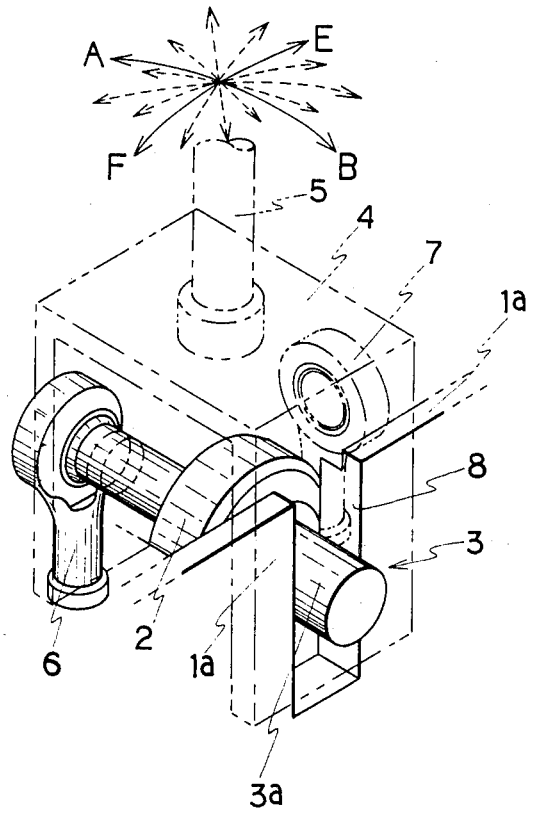
FIG. 3 is a segmentary perspective view showing a neighborhood portion of a main shaft of the embodiment of the control device of the invention shown in FIG. 1.

An embodiment of a control device for control cables of the present invention is described with reference to the accompanying drawings. The drawings show a device in which a single lever is employed to operate two cables, as an embodiment. Referring FIGS. 1 to 3, 1 is a housing. An outer member of a spherical bearing 2 is fixed to a base plate 1*a* provided generally perpendicular to a top portion of a housing 1.

A main shaft 3 is inserted and fixed into an axial hall of an inner member of the spherical bearing 2. Both end portions of the main shaft 3 are respectively fixed to a lever base 4 to which a lever 5 is joined. A guide-axis-portion 3*a* is provided with the outer surface of one end portion of the main shaft 3. The first ball joint 6 for connecting the first cable is pivotally provided with the other end portion of the main shaft 3 inserted through the lever base 4.

Further, the second ball joint 7 for connecting the second cable is pivotally provided with the lever base 4. The second ball joint 7 is arranged on an extension line which is directed almost perpendicularly and horizontally to the axial line of the above spherical bearing 2. A guide stopper 8 is formed by cutting the base plate 1*a* of the housing 1 in the perpendicular direction to the main shaft 2. The guide stopper 8 is provided in a neighborhood of the above spherical bearing 2. The guide stopper 8 is constructed so as to smoothly guide the guide-axis-portion 3*a* with both inner side surfaces thereof. The guide stopper 8 constitutes a mechanism for preventing the main shaft 3 from horizontally rotating by means of the spherical bearing 2 and for allowing the main shaft only to pitch in the vertical direction (seesaw-action) with the spherical bearing 2 as a fulcrum.

Hereinafter, actions and effects of the above control device of an embodiment of the present invention are described. With reference to FIG. 1, when the lever 5 is operated so as to be inclined in the direction of an arrow A or B, the main shaft 3 inserted and fixed into the spherical bearing 2 takes a seesaw-action in the vertical direction. Therefore, the first ball joint 6 pivotally provided at one side of the main shaft 3 swings in the direction of an arrow D or C around the center of the spherical bearing. Accordingly, an inner cable 11 of the first cable 9 shown by broken lines, which is connected to the first ball joint 6, slides in the direction of an arrow $D_1$ or $C_1$, and a remote driven apparatus (not shown in the drawings) is operated.

With reference to FIG. 2, when a lever 5 is operated so as to be inclined in the direction of an arrow E or F, the lever base 4 swings around the center axis of the main shaft by means of the spherical bearing 2. Therefore, the second ball joint 7 pivotally provided on an extension line which is directed in the perpendicular and horizontal direction to the center axis of the spherical bearing 2, is swung in the direction of an arrow H or G. Accordingly, an inner cable 12 of the second cable 10 shown by broken lines, which is connected to the second ball joint 7, slides in the direction of an arrow $H_1$ or $G_1$ and a remote driven apparatus (not shown in drawings) is operated through the inner cable 12.

As described above, the cables 9 and 10 can be controlled independently together by means of the single lever 5.

Further, in the device of this embodiment, the swing directions are not limited only in the directions of arrows A, B, E and F, but the lever 5 can be operated so as to be inclined in the direction to which an arrow A or B and an arrow E or F are combined together in a certain ratio. That is to say, the lever 5 can be operated in all directions. Therefore, in case that two cables are employed, e.g. in case of the above embodiment, two driven apparatuses or two movable portions of a driven apparatus can be simultaneously operated by means of a single lever. Further, the driven apparatuses or portions can be easily controlled into operable positions according to the above numberless combinations of the operations. Therefore, the device of the present invention is most useful for delicately controlling apparatuses, especially for controlling hydraulic valves of a construction machinery, or the like.

Also, in the device of the present invention, there is little necessity to prepare the members constituting the device through cutting processes due to the construction thereof. The device of the present invention can be constructed with general articles on the market or comparative simple members, e.g. pressed steel plates, or the like. Accordingly, the device of the present invention is cheaply manufactured and can be made small and light in comparison with conventional devices.

Though, in the above explanations and drawings, a preferred embodiment of a control device of the invention by which two cables are operated has been described, the device of the present invention can be modified into a control device (not shown in drawings) in which a single lever is employed to operate more than two cables simultaneously or individually, and various changes and modifications may be made in the invention without departing from the spirit and scope thereof.

What is claimed is:

1. A control device for control cables for operating a remote driven apparatus through at least two control cables by means of a single lever, comprising:

(a) a housing;

(b) a spherical bearing fixed to a base plate provided generally perpendicular to a top portion of said housing;

(c) a main shaft inserted and fixed into said spherical bearing;

(d) a lever base to which both end portions of said main shaft are fixed;

(e) a single lever fixed to said lever base;

(f) at least two ball joints for connecting cables, which are respectively provided pivotally with said lever base and in which the first ball joint is arranged on the extension line of a center axis of said main shaft and the second ball joint is arranged on extension line in the perpendicular direction to a center axis of said spherical bearing, respectively;

(g) a guide-axis-portion provided with at least one end portion of said main shaft; and (h) a guide stopper formed by cutting said base plate of said housing at the neighborhood of said spherical bearing, and having cut side surfaces into which said guide-axis-portion is inserted so as to prevent said main shaft from rotating horizontally.

* * * * *